US010344630B2

(12) United States Patent
Choi et al.

(10) Patent No.: US 10,344,630 B2
(45) Date of Patent: Jul. 9, 2019

(54) VARIABLE VALVE CONTROL SYSTEM HAVING COMMON VALVE AND ENGINE SYSTEM HAVING THE SAME

(71) Applicants: Hyundai Motor Company, Seoul (KR); Kia Motors Corporation, Seoul (KR)

(72) Inventors: Myung-Sik Choi, Seoul (KR); Young-Hong Kwak, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/837,894

(22) Filed: Dec. 11, 2017

(65) Prior Publication Data

US 2019/0048762 A1 Feb. 14, 2019

(30) Foreign Application Priority Data

Aug. 11, 2017 (KR) ..... 10-2017-0102343

(51) Int. Cl.

| | |
|---|---|
| ***F01L 1/34*** | (2006.01) |
| ***F01L 1/24*** | (2006.01) |
| ***F01L 13/00*** | (2006.01) |
| ***F01M 1/02*** | (2006.01) |
| *F01L 1/047* | (2006.01) |

(52) U.S. Cl.

CPC ..... *F01L 1/24* (2013.01); *F01L 13/0005* (2013.01); *F01M 1/02* (2013.01); *F01L 1/047* (2013.01); *F01L 2001/2444* (2013.01); *F01L 2013/001* (2013.01); *F01L 2013/105* (2013.01)

(58) Field of Classification Search

CPC ..... F01L 1/24; F01L 1/047; F01L 13/0005; F01L 2001/2444; F01L 2013/001; F01L 2013/105; F01M 1/02

See application file for complete search history.

(56) References Cited

U.S. PATENT DOCUMENTS

| | | | | |
|---|---|---|---|---|
| 5,353,755 | A | 10/1994 | Matsuo et al. | |
| 6,691,652 | B2 * | 2/2004 | Kammerdiener | F01L 1/143 123/198 F |
| 8,915,225 | B2 * | 12/2014 | Zurface | F01L 1/18 123/90.39 |
| 2015/0167582 | A1 | 6/2015 | Hwang | |

FOREIGN PATENT DOCUMENTS

| | | | |
|---|---|---|---|
| JP | 2016-044624 | A | 4/2016 |
| KR | 2009-0036823 | A | 4/2009 |
| KR | 2015-0144618 | A | 3/2016 |

* cited by examiner

*Primary Examiner* — Zelalem Eshete

(74) *Attorney, Agent, or Firm* — Morgan, Lewis & Bockius LLP

(57) ABSTRACT

A variable valve control system may include a variable valve mechanism having latching pins for performing variable valve lift by a pressure difference of oil, an oil control circuit block having a low-pressure oil line and a high-pressure oil line to control ON/OFF of the latching pins, and a rotation shaft valve having oil passages for switching the low-pressure oil line and the high-pressure oil line.

16 Claims, 14 Drawing Sheets

LAYOUT OF ROTARY SHAFT VALVE CONTROL HOLE

| ANGLE OF ROTATION OF SHAFT | #1 | #2 | #3 | #4 | #5 | #6 | #7 | #8 |
|---|---|---|---|---|---|---|---|---|
| 0 | 0 | 0 | 0 | 0 | 0 | 0 | 0 | 0 |
| 90 | 1 | 1 | 0 or 1 | 1 | 0 or 1 | 1 | 0 | 0 |
| 180 | 0 | 0 | 1 | 0 | 1 | 0 | 1 | 1 |
| 270 | 1 | 0 | 1 | 0 | 1 | 1 | 1 | 1 |

0: NO OIL HOLE FOR CONTROL, 1: THERE IS AN OIL HOLE FOR CONTROL.

| | | TWO-STAGE MECHANISM (VVL) | THREE-STAGE MECHANISM (CDA+VVL) | | THREE-STAGE MECHANISM (CDA+VVL) | | TWO-STAGE MECHANISM (VVL) | TWO-STAGE MECHANISM (CDA) | TWO-STAGE MECHANISM (CDA) |
|---|---|---|---|---|---|---|---|---|---|
| | | #1 | #2 | #3 | #4 | #5 | #6 | #7 | #8 |
| OFF=0 (LOW OIL PRESSURE) | | UN-LATCHING | UN-LATCHING | LATCHING | UN-LATCHING | LATCHING | UN-LATCHING | LATCHING | LATCHING |
| ON=1 (HIGH OIL PRESSURE) | | LATCHING | LATCHING | UN-LATCHING | LATCHING | UN-LATCHING | LATCHING | UN-LATCHING | UN-LATCHING |
| FOUR CYLINDERS | NORMAL | 0 | 0 | 0 | 0 | 0 | 0 | 0 | 0 |
| | ATKINSON | 1 | 1 | 0 or 1 | 1 | 0 or 1 | 1 | 0 | 0 |
| TWO CYLINDERS | NORMAL | 0 | 0 | 1 | 0 | 1 | 0 | 1 | 1 |
| | ATKINSON | 1 | 0 | 1 | 0 | 1 | 1 | 1 | 1 |

FIG. 14

VARIABLE VALVE CONTROL SYSTEM HAVING COMMON VALVE AND ENGINE SYSTEM HAVING THE SAME

CROSS-REFERENCE TO RELATED APPLICATIONS

The present application claims priority to Korean Patent Application No. 10-2017-0102343, filed on Aug. 11, 2017, the entire contents of which is incorporated herein for all purposes by this reference.

BACKGROUND OF THE INVENTION

Field of the Invention

The present invention relates to a variable valve control system, and more particularly, to an engine system including a variable valve control system operated without an oil control valve causing a complicated hydraulic circuit.

Description of Related Art

In general, a variable valve control system includes a variable valve mechanism that includes a cylinder deactivation (hereinafter, referred to as "CDA") device and a variable valve lift (hereinafter, referred to as "VVL") device or includes a CDA or VVL device, an oil control circuit configured to supply an oil pressure, and an oil control valve (hereinafter, referred to as "OCV") for controlling the supply of the oil pressure.

Accordingly, the variable valve control system may perform individual control or integrated control of CDA and VVL for a further improvement in fuel efficiency by controlling the latching operation (i.e., latching ON) or unlatching operation (i.e., latching OFF) of a latching pin in a variable stage manner including first, second and third stages (e.g., zero, normal, and high), according to the control of the OCV.

As a result, the variable valve control system may operate an engine in various engine control modes and be used for various engine systems.

By way of example, a four-cylinder engine may be operated in engine control modes including an engine control mode 1 in which four-cylinder combustion is performed by single lift control of intake and exhaust valves, an engine control mode 2 in which two-cylinder combustion is performed by single lift control of intake and exhaust valves and two-cylinder deactivation is performed by 0 (zero) lift control of intake and exhaust, an engine control mode 3 in which four-cylinder combustion is performed by two-stage lift control of an intake valve and single lift control of an exhaust valve, an engine control mode 4 in which two-cylinder deactivation is performed by 0 (zero) lift control of intake and exhaust, and an engine control mode 5 in which four-cylinder deactivation is performed by 0 (zero) lift control of intake and exhaust.

Furthermore, the four-cylinder engine may be operated by engine systems including a first-type engine system that enables realization of the engine control modes 1 and 2, a second-type engine system that enables realization of the engine control modes 1, 2, 3, and 4, and a third-type engine system that enables realization of the engine control modes 1, 2, 3, 4 and 5.

Thus, the variable valve control system significantly contributes to an improvement in fuel efficiency by controlling various valves for each driving region while increasing marketability by various engine systems and engine control modes.

However, the variable valve control system requires the OCV to control an oil pressure for each of the engine control modes 1, 2, 3, 4 and 5.

By way of example, the oil control circuit of the variable valve control system includes a main gallery, a control gallery, a drain hole, an OCV, an orifice, and a relief valve.

The main gallery functions as an oil line which is directly connected to a block or a head from an oil pump. The control gallery functions as an oil line that connects an outlet end portion of the OCV to a latching pin of a variable valve lift device.

When the pressure in the control gallery is higher than a relief spring force, a relief valve is opened so that oil is discharged through the drain hole to lower the pressure. The OCV includes a solenoid, a pintle, a check ball, spring, etc., and is located between the main gallery and the control gallery. The pintle pushes the check ball in the OCV when the OCV is turned on, with the consequence that the passages in the main gallery and control gallery are opened while the relief valve is pressed against a relief valve seat to block the passage between the control gallery and the drain hole, preventing oil from leaking from the control gallery.

On the other hand, the pintle is returned to an original position thereof and the check ball moves upward in the OCV when the OCV is turned off, with the consequence that the passages in the main gallery and control gallery are blocked while the pintle is lifted from the relief valve so that a gap is formed therebetween, in which case the relief valve spring serves to restrict movement of the relief valve. The orifice is located between the main gallery and the control gallery and serves to supply oil such that the control gallery is continuously filled with oil. The relief valve is opened when the differential pressure between a drain line and the control gallery is larger than a mounting load of the relief spring, and the relief valve is closed when the differential pressure is less than the mounting load. Thus, the relief valve functions to uniformly maintain the differential pressure between the drain line and the control gallery when the OCV is turned off.

Therefore, the number of OCVs is increased as the number of engine control modes is increased, causing an increase in the number of parts including main galleries, control galleries, drain holes, orifices, and relief valves, and thus leading to complexity of the oil control circuit.

For the present reason, the variable valve control system, which is applied to the third-type engine system that realizes the engine control modes 1, 2, 3, 4 and 5, may require a complicated oil control circuit with a large number of OCVs, which may lead to a loss of product competitiveness due to an increase in price and investment cost.

Moreover, the variable valve control system should be necessarily used to realize an optimal valve mode for each driving region. Hence, when both of half cylinder deactivation (or overall cylinder deactivation) and VVL are applied to one engine, there may be a problem relating to engine system packaging due to an increase in the number of components, and at the same time, a problem relating to an increase in cost.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a variable valve control system in which one rotation shaft valve is configured as a common valve to equally perform a plurality of OCV functions, simplifying a system, in which engine control modes are performed, without a packing difficulty and an increase in cost, and which is configured for achieving an improvement in fuel efficiency by selective application of VVL and CDA in middle and high load/low load regions of an engine and during coasting and of increasing marketability through an improvement in fuel efficiency and a torque by optimally controlling intake and exhaust valves according to various driving regions, and an engine system having the same.

Other aspects of the present invention can be understood by the following description, and become apparent with respect to the exemplary embodiments of the present invention. Also, it is obvious to those skilled in the art to which the present invention pertains that the objects and advantages of the present invention can be realized by the means as claimed and combinations thereof.

In accordance with exemplary embodiments of the present invention, a variable valve control system includes a variable valve mechanism having latching pins for performing variable valve lift by a pressure difference of oil, an oil control circuit block having a low-pressure oil line and a high-pressure oil line to control ON/OFF of the latching pins, and a rotation shaft valve having oil passages for switching the low-pressure oil line and the high-pressure oil line.

The oil passages may be matched with the latching pins one to one, and be disposed in a longitudinal direction of the rotation shaft valve to correspond to the number of latching pins. The rotation shaft valve may be built in the oil control circuit block, and the oil control circuit block may be connected to the variable valve mechanism.

The oil control circuit block may include the high-pressure oil line formed inside the rotation shaft valve using a shaft hole of the rotation shaft valve for supply of the high-pressure oil, the low-pressure oil line formed outside the rotation shaft valve for supply of the low-pressure oil, a main gallery through which the oil is supplied to the high- and low-pressure oil lines so that the high- and low-pressure oil lines are filled with the oil, and a control gallery fluidically-communicating with the oil passages so that the low-pressure oil and the high-pressure oil switched by the rotation shaft valve are supplied to the latching pins Each of the oil passages may include an oil groove recessed on a circumferential surface of the rotation shaft valve, and an oil control hole circumferentially formed to fluidically-communicate with the shaft hole while forming a phase angle difference of 90° with the oil groove, and the low-pressure oil may be supplied to the control gallery through the oil groove and the high-pressure oil may be supplied to the control gallery through the oil control hole.

The high- and low-pressure oil lines may be connected to an orifice acting such that the low-pressure oil line is always filled with the oil, and the low-pressure oil line may be provided with a relief valve configured to lower an increase of pressure in the low-pressure oil line using a drain hole.

The rotation shaft valve may be connected to an actuator, the actuator may adjust an rotation angle of the rotation shaft valve, and the adjustment of the rotation angle may allow the low-pressure oil and the high-pressure oil to be switched in the oil passages.

In accordance with exemplary embodiments of the present invention, an engine system includes a variable valve control system including a variable valve mechanism having latching pins for performing variable valve lift such that the latching pins are changed from OFF to ON by a pressure difference of oil, an oil control circuit block having a high-pressure oil line filled with high-pressure oil for turning on the latching pins, a low-pressure oil line filled with low-pressure oil for turning off the latching pins, and a control gallery through which the high- and low-pressure oil lines are connected to the latching pins, a rotation shaft valve having oil passages for switching the low-pressure oil line and the high-pressure oil line connected to the control gallery, and an actuator configured to adjust an rotation angle of the rotation shaft valve, allowing the low- and high-pressure oil lines to be switched in the oil passages, and a controller to control the actuator.

The variable valve control system may include a variable intake valve mechanism provided at an intake side of an engine and including a three-stage CDA/VVL mechanism and a two-stage VVL mechanism as the variable valve mechanism, and a variable exhaust valve mechanism provided at an exhaust side and including a two-stage CDA mechanism and a single standard mechanism as the variable valve mechanism. The three-stage CDA/VVL mechanism may use CDA latching pins and VVL latching pins as the latching pins, the two-stage CDA mechanism may use the CDA latching pins as the latching pins, and the two-stage VVL mechanism may use the VVL latching pins as the latching pins.

The methods and apparatuses of the present invention have other features and advantages which will be apparent from or are set forth in more detail in the accompanying drawings, which are incorporated wherein, and the following Detailed Description, which together serve to explain certain principles of the present invention.

BRIEF DESCRIPTION OF THE DRAWINGS

FIG. 14 is a view illustrating an integrated control operation of CDA/VVL using the two- and three-stage variable valve mechanisms of the engine system according to the exemplary embodiment of the present invention.

Figure 1:
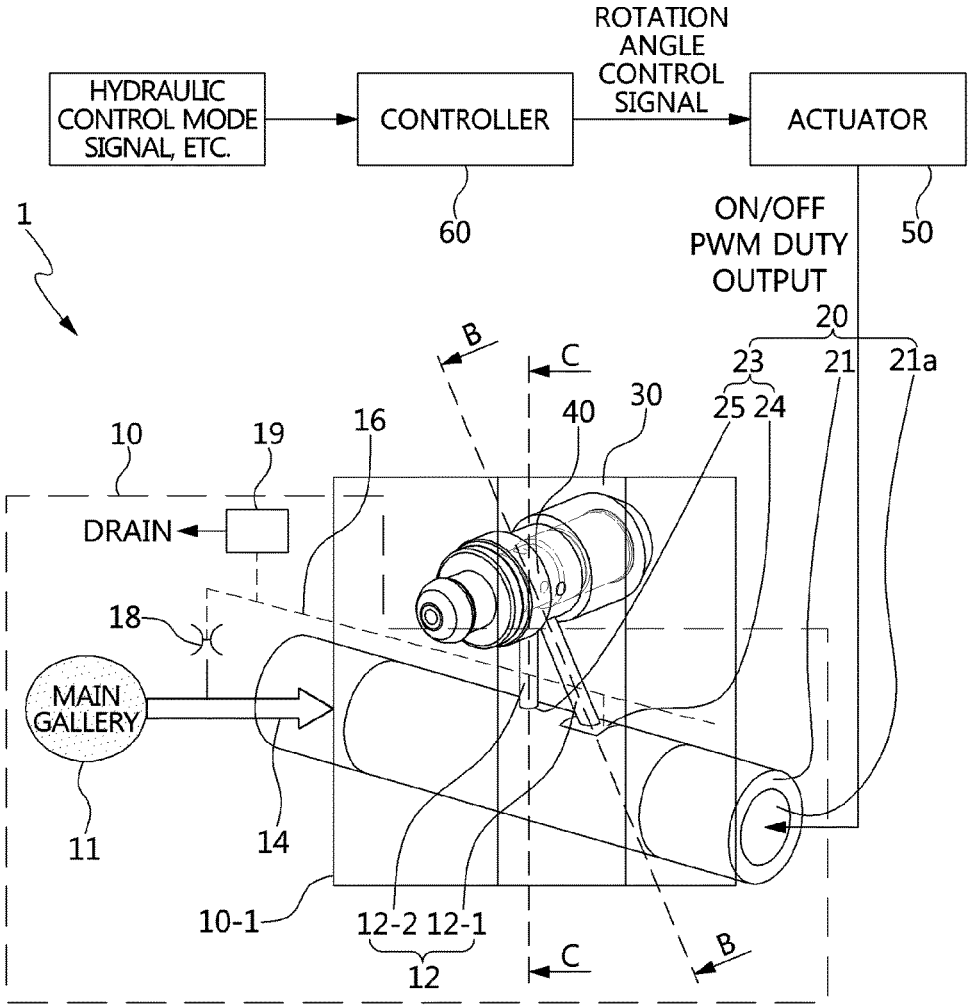
FIG. 1 is a diagram illustrating a variable valve control system, which includes a rotation shaft valve as a common valve and a three-stage variable valve mechanism, according to an exemplary embodiment of the present invention.

It may be understood that the appended drawings are not necessarily to scale, presenting a somewhat simplified representation of features illustrative of the predetermined principles of the invention. The predetermined design features of the present invention as disclosed wherein, including, for example, predetermined dimensions, orientations, locations, and shapes will be the determined in part by the particularly intended application and use environment.

In the figures, reference numbers refer to the same or equivalent parts of the present invention throughout the several figures of the drawing.

DETAILED DESCRIPTION

Reference will now be made in detail to embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also alternatives, modifications, equivalents and other embodiments, which may be included within the spirit and scope of the invention as defined by the appended claims.

Exemplary embodiments of the present invention will be described below in more detail with reference to the accompanying drawings. The present invention may, however, be embodied in different forms and should not be construed as limited to the exemplary embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Referring to FIG. 1, a variable valve control system 1 includes an oil control circuit block 10, a rotation shaft valve 20, a variable valve mechanism 30, a latching pin 40, an actuator 50, and a controller 60. By way of example, the oil control circuit block 10 includes the rotation shaft valve 20, the variable valve mechanism 30 includes the latching pin 40, the actuator 50 rotates the rotation shaft valve 20, and the controller 60 control on/off of the actuator 50.

In detail, the oil control circuit block 10 includes a block body 10-1 and a hydraulic circuit, and the hydraulic circuit includes a main gallery 11, a control gallery 12, a high-pressure oil line 14, a low-pressure oil line 16, an orifice 18, and a relief valve 19.

For example, the block body 10-1 having the hydraulic circuit formed therein may be a separate component connected to the variable valve mechanism 30, a housing component of the variable valve mechanism 30, or a component of a cylinder head, cylinder cover, or cylinder block of an engine.

For example, the main gallery 11 and the control gallery 12 act as a path for supply and discharge of oil. To the present end, the main gallery 11 is configured as a passage for supply of oil from the outside thereof to the block body 10-1, and the control gallery 12 is configured as a passage for discharge of the oil supplied to the block body 10-1 to the latching pin 40. Especially, the control gallery 12 is an oil line which is connected from the rotation shaft valve 20 to the latching pin 40. When the control gallery 12 is connected to an oil control hole 25 for supply of oil, the control gallery 12 is configured to turn on the latching pin 40. On the other hand, when the control gallery 12 is not connected to the oil control hole 25, the control gallery 12 is connected to the low-pressure oil line 16 through an oil groove 24 and is configured to turn off the latching pin 40 while the oil pressure in the control gallery 12 is lowered by the relief valve 19.

Therefore, although the control gallery 12 may be one passage for selective discharge of low-pressure oil and high-pressure oil, it is divided into a low-pressure gallery 12-1 that is configured as a passage for discharge of low-pressure oil to the latching pin 40, and a high-pressure gallery 12-2 that is configured as a passage for discharge of high-pressure oil to the latching pin 40. The low-pressure gallery 12-1 and the high-pressure gallery 12-2 are configured to connect the rotation shaft valve 20 and the latching pin 40 in the block body 10-1.

For example, the high-pressure oil line 14 and the low-pressure oil line 16 allow the oil to be low-pressure oil and high-pressure oil in the block body 10-1. The orifice 18 and the relief valve 19 controls low-pressure oil. To the present end, the high-pressure oil line 14 is formed in the rotation shaft valve 20 and is connected to the main gallery 11, and the low-pressure oil line 16 is formed around the rotation shaft valve 20 in the block body 10-1 and is connected to the main gallery 11. Especially, since oil is drained through the low-pressure oil line 16 by a higher pressure difference than the relief valve spring between the oil pressure in the control gallery 12 and a drain of the relief valve 19, low pressure may be maintained in the low-pressure oil line 16.

The orifice 18 is located between the main gallery 11 and the low-pressure oil line 16 and acts such that the low-pressure oil 16 is always filled with oil. The relief valve 19 has a drain (i.e., drain hole), and is disposed in the low-pressure oil line 16. The relief valve 19 is opened to maintain low pressure and drain oil when the pressure difference between the low-pressure oil line 16 (or the control gallery 12) and the drain (i.e. The drain hole) is higher than the relief valve spring.

In detail, the rotation shaft valve 20 includes a shaft body 21 and an oil passage 23. The shaft body 21 has a hollow shape which is open at one side thereof and has a shaft hole 21*a* formed at the other closed side thereof. The shaft hole 21*a* is connected to the main gallery 11 to form the high-pressure oil line 14. The oil passage 23 includes the oil groove 24 which is recessed on the circumferential surface of the shaft body 21, and the oil control hole 25 which is circumferentially formed in the shaft body 21 to fluidically-communicate with the shaft hole 21*a*. The oil groove 24 connects the control gallery 24 (or the low-pressure gallery 12-1) and the low-pressure oil line 16, and the oil control hole 25 connects the control gallery 12 (or the high-pressure gallery 12-1) and the high-pressure oil line 14. Especially, the oil control hole 25 circumferentially forms a predetermined phase angle difference (e.g., about 90°) with the oil groove 24.

In detail, the variable valve mechanism 30 is a variable valve lift device that controls a valve lifting height according to an engine rotation region, and the latching pin 40 is disposed in the variable valve mechanism 30 and is latched or unlatched by oil pressure to adjust the valve lifting height in a variable manner (e.g., first, second, or third stage). Therefore, the variable valve mechanism 30 and the latching pin 40 are similar to a typical variable valve lift device (see FIG. 10).

In detail, the actuator 50 is driven by control of the controller 60 to rotate the rotation shaft valve 20 in a forward or reverse direction thereof. The controller 60 basically controls on/off of the actuator 50, and generates the output of the actuator 50 as pulse width modulation (PWM) duty for accurately controlling an rotation angle of the rotation shaft valve 20.

Figure 2:
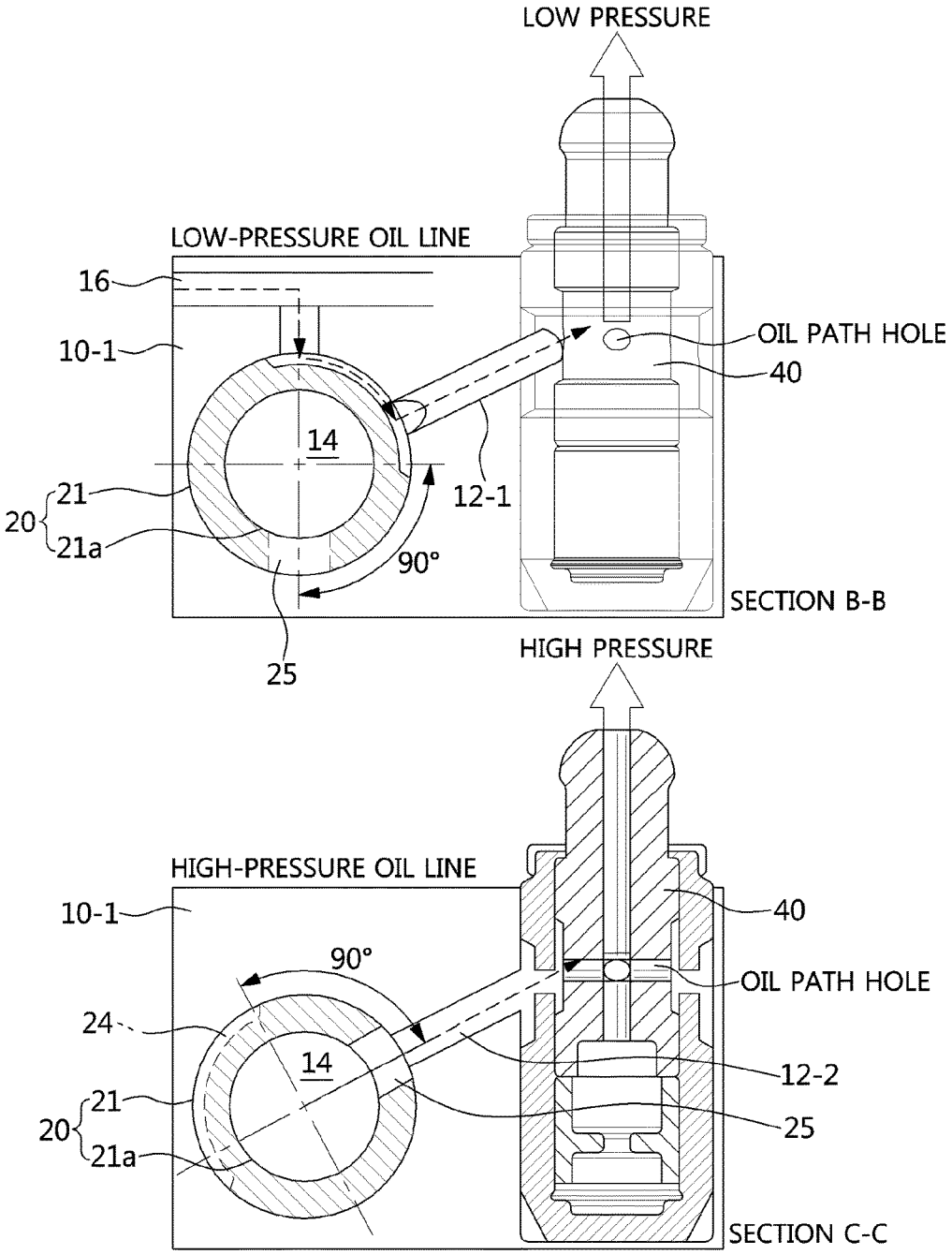
FIG. 2 is a view illustrating connection of the rotation shaft valve to a latching pin through an oil control circuit according to the exemplary embodiment of the present invention.

FIG. 2 illustrates hydraulic control by the rotation of the rotation shaft valve 20. As in section B-B of FIG. 2, the oil groove 24 is connected to the low-pressure gallery 12-1 such that the high-pressure oil in the shaft hole 21*a* of the shaft body 21 is not discharged to the high-pressure gallery 12-2 through the oil control hole 25, and thus only low-pressure oil in the low-pressure oil line 16 may be supplied to the latching pin 40. On the other hand, as in section C-C of FIG. 2, the oil control hole 25 is connected to the high-pressure gallery 12-2 such that the low-pressure oil in the low-pressure oil line 16 is not discharged to the low-pressure gallery 12-1 through the oil groove 24, and thus only high-pressure oil in the high-pressure oil line 14 may be supplied to the latching pin 40.

Figure 3:
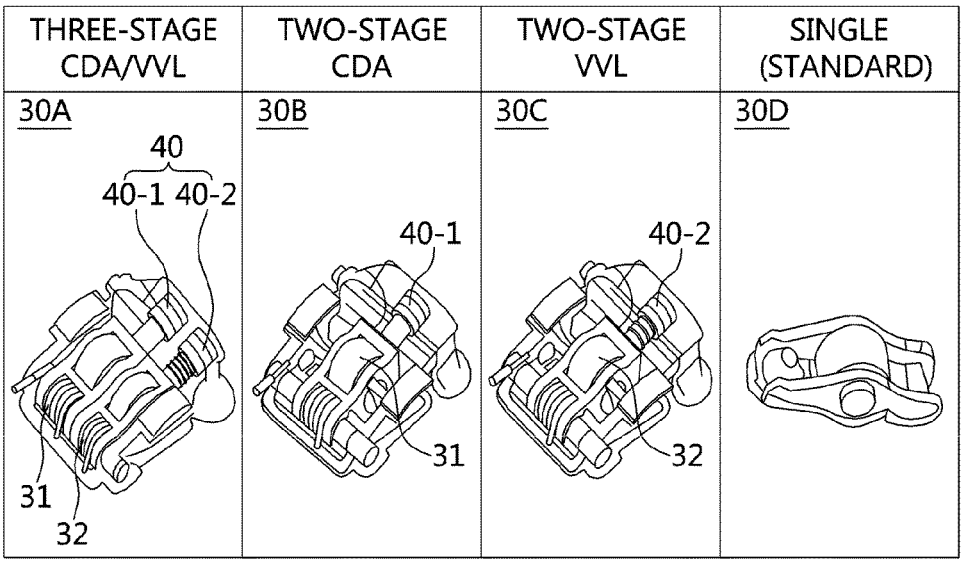
FIG. 3 is an example of a variable valve mechanism used for an engine system according to the exemplary embodiment of the present invention.
Figure 4:
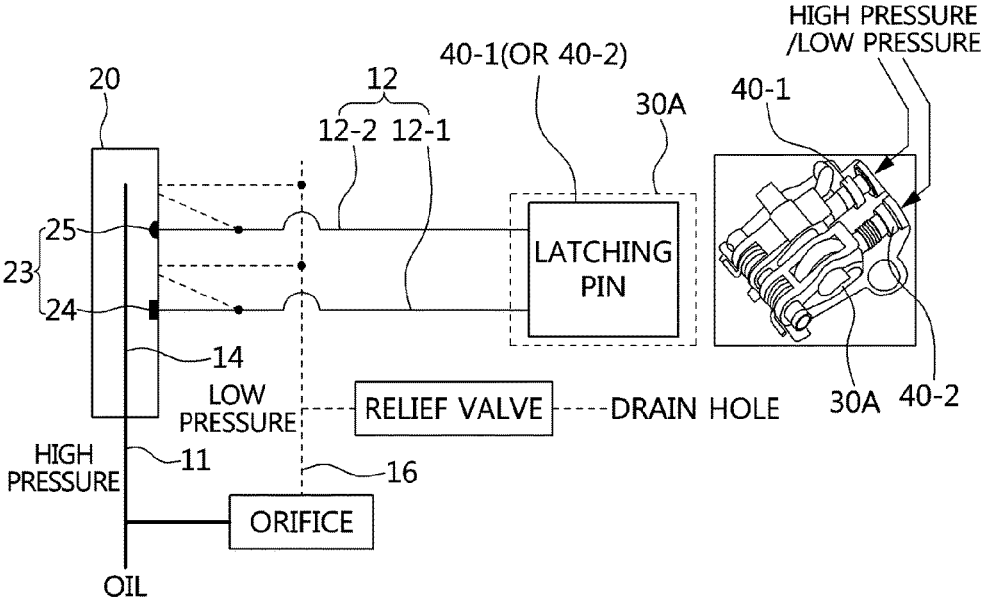
FIG. 4 is a view illustrating layout of the oil control valve configured with the three-stage variable valve mechanism according to the exemplary embodiment of the present invention.
Figure 5:
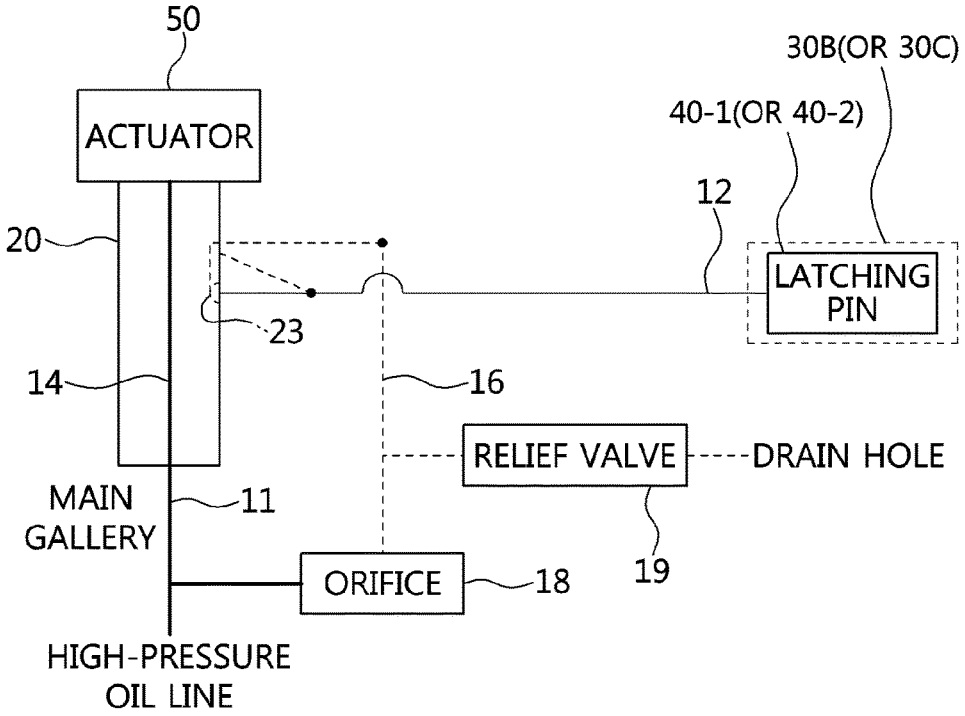
FIG. 5 is a view illustrating layout of the oil control valve configured with a two-stage variable valve mechanism according to the exemplary embodiment of the present invention.

Meanwhile, FIG. 3, FIG. 4, and FIG. 5 illustrate an example of layout of the oil control circuit according to the type of the variable valve mechanism 30 in the variable valve control system 1. In the instant case, the latching pin 40 is divided into a CDA latching pin 40-1 and a VVL latching pin 40-2 according to types, and they have the same effect.

Referring to FIG. 3, the variable valve mechanism 30 is divided into a three-stage CDA/VVL mechanism 30A, a two-stage CDA mechanism 30B, a two-stage VVL mechanism 30C, and a single standard mechanism 30D. However, the variable valve mechanism 30 may be extended to a continuously variable valve lift (CVVL) device that improves a VVL function, a variable valve timing (VVT) device that adjusts an opening or closing timing and amount of a valve according to the rotation region of an engine to control an overlap timing so that a filling amount and remaining gas amount of a cylinder are adjustable, a continuously variable valve timing (CVVT) device that improves a VVT function, or the like.

In detail, the three-stage CDA/VVL mechanism 30A includes a CDA device 31 which is connected to the CDA latching pin 40-1, and a VVL device 32 which is connected to the VVL latching pin 40-2, and controls valve lift in a variable three-stage manner including first stage (zero)/second stage (normal)/third stage (high). The two-stage CDA mechanism 30B includes a CDA device 31 which is connected to the CDA latching pin 40-1, and controls valve lift in a variable two-stage manner including first stage (normal)/second stage (high). The two-stage VVL mechanism 30C includes a VVL device 32 which is connected to the VVL latching pin 40-2, and controls valve lift in a variable two-stage manner including first stage (normal)/second stage (high). The single standard mechanism 30D controls valve lift in a single manner including first stage (normal). Here, the terms "normal, high, and zero" are merely example.

FIG. 4 illustrates an example of the variable valve control system 1 in which the oil control circuit is formed by application of the three-stage CDA/VVL mechanism 30A as the variable valve mechanism 30. In the instant case, the control gallery 12 is divided into a low-pressure gallery 12-1 which is connected to a low-pressure line, and a high-pressure gallery 12-2 which is connected to a high-pressure line, and includes a plurality of lines connected to the respective CDA latching pin 40-1 and VVL latching pin 40-2 included in the three-stage CDA/VVL mechanism 30A. Therefore, low-pressure is supplied to the CDA latching pin 40-1 and VVL latching pin 40-2 through the low-pressure gallery 12-1, and high-pressure oil is supplied to the CDA latching pin 40-1 and VVL latching pin 40-2 through the high-pressure gallery 12-2.

FIG. 5 illustrates an example of the variable valve control system 1 in which the oil control circuit is formed by application of the two-stage CDA mechanism 30B or the two-stage VVL mechanism 30C as the variable valve mechanism 30. In the instant case, the control gallery 12 is divided into a low-pressure gallery 12-1 which is connected to a low-pressure line, and a high-pressure gallery 12-2 which is connected to a high-pressure line, and includes a single line which is connected to the CDA latching pin 40-1 of the two-stage CDA mechanism 30B the VVL latching pin 40-2 of the two-stage VVL mechanism 30C.

Accordingly, the oil control circuit having the rotation shaft valve 20 may have an advantage in that the design of the variable valve mechanism 30 is hardly changed regardless of the three-stage CDA/VVL mechanism 30A, the two-stage CDA mechanism 30B, or the two-stage VVL mechanism 30C.

Meanwhile, FIG. 6, FIG. 7, FIG. 8, and FIG. 9 illustrate a hydraulic state in the CDA device 31 and the VVL device 32 according to the on/off of the actuator 50 in the variable valve control system 1.

Figure 6:
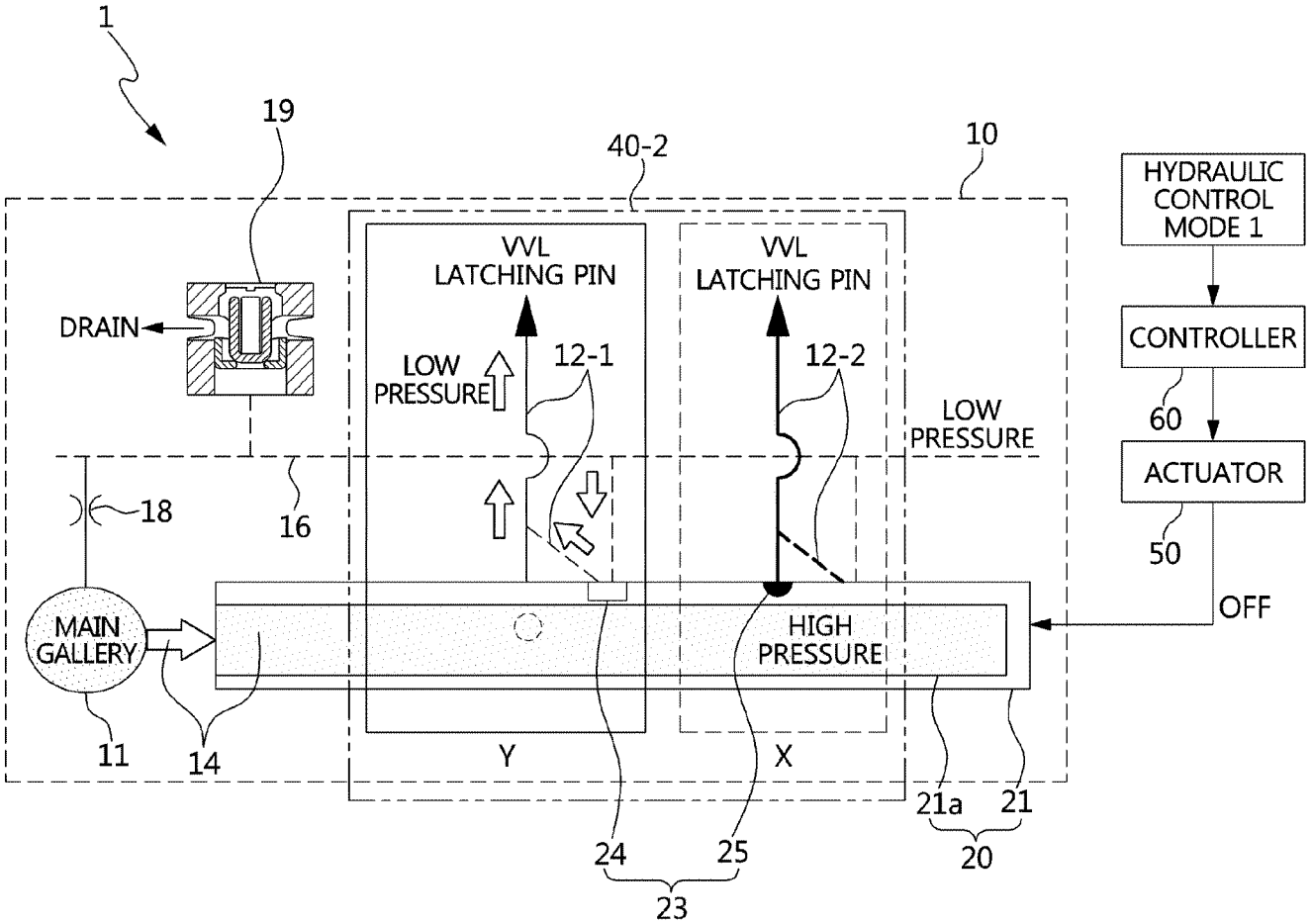
FIG. 6 is a view illustrating a state in which, when the rotation shaft valve is turned off (mode 1), among CDA and VVL devices, the VVL device is operated by supply of low-pressure oil through a low-pressure gallery of a VVL latching pin and the CDA device is not operated by non-supply of high-pressure oil, according to the exemplary embodiment of the present invention.
Figure 7:
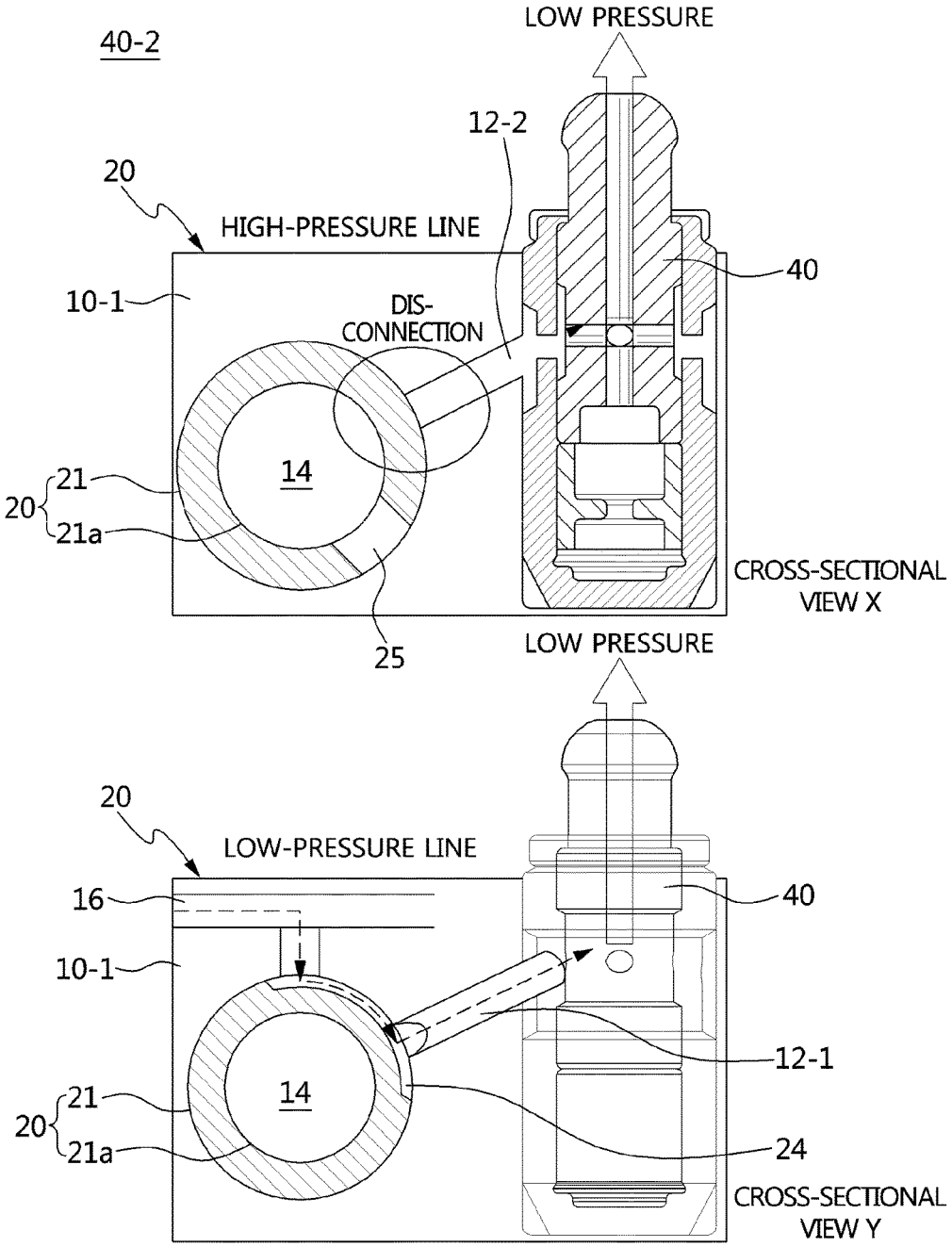
FIG. 7 is a view illustrating supply of low-pressure oil in the oil control circuit when the rotation shaft valve is turned off (mode 1).
Figure 8:
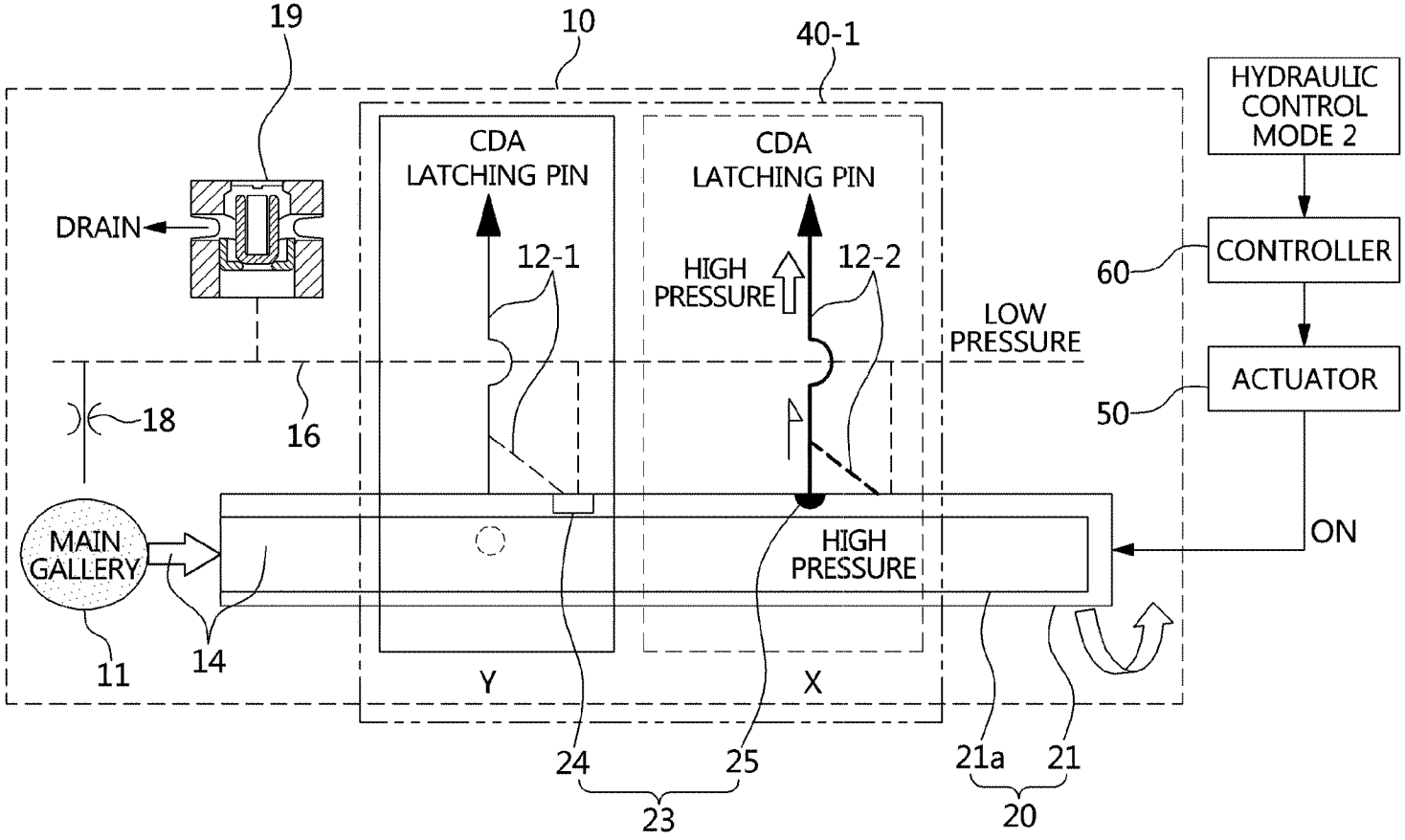
FIG. 8 is a view illustrating a state in which, when the rotation shaft valve is turned on (mode 2), among the CDA and VVL devices, the CDA device is operated by supply of high-pressure oil through a high-pressure gallery of a CDA latching pin and the VVL device is not operated by non-supply of low-pressure oil, according to the exemplary embodiment of the present invention.
Figure 9:
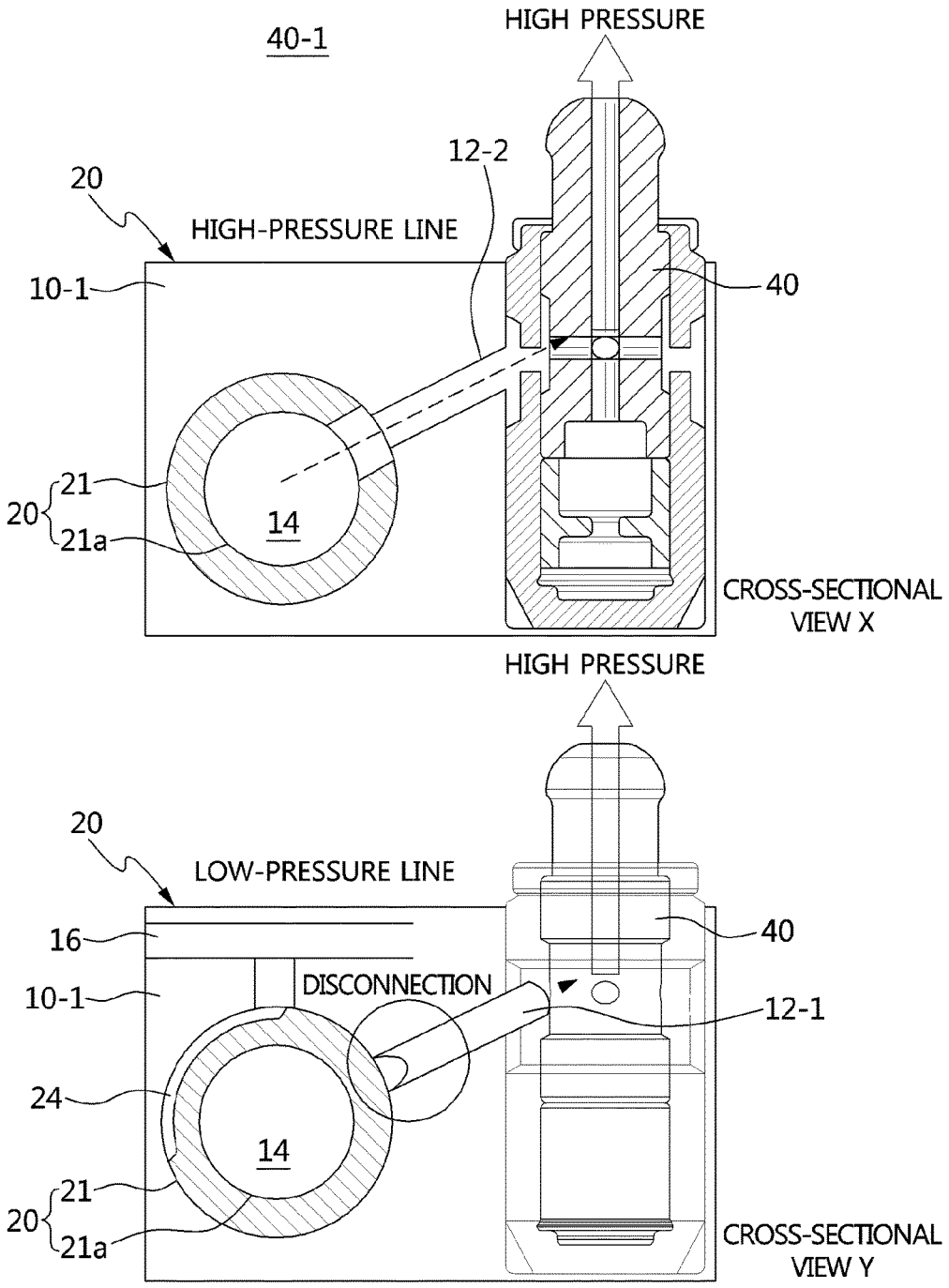
FIG. 9 is a view illustrating supply of high-pressure oil in the oil control circuit when the rotation shaft valve is turned on (mode 2).

For example, when the actuator 50 is turned off, high-pressure oil is not supplied so that the VVL device 32 is operated and wherein the CDA device 31 is not operated. On the other hand, when the actuator 50 is turned on, high-pressure oil is supplied so that the VVL device 32 is not operated and the CDA device 31 is operated. FIG. 6 and FIG. 7 illustrate an example of the VVL latching pin 40-2 connected to the low-pressure and high-pressure galleries 12-1 and 12-2 of the oil control circuit block 10 when the actuator 50 is turned off. FIG. 7 and FIG. 8 illustrate an example of the CDA latching pin 40-1 connected to the low-pressure and high-pressure galleries 12-1 and 12-2 of the oil control circuit block 10 when the actuator 50 is turned on.

Although the oil control circuit block 10 in FIG. 6 includes the CDA latching pin 40-1 and the VVL latching pin 40-2 together, only the VVL latching pin 40-2 is illustrated for convenience of description. Although the oil control circuit block 10 in FIG. 7 includes the CDA latching pin 40-1 and the VVL latching pin 40-2 together, only the CDA latching pin 40-1 is illustrated for convenience of description.

Referring to FIG. 6, in a hydraulic control mode 1, the controller 60 is configured to control actuator to be turned off. As such, the actuator 50 sets the position of the rotation shaft valve 20 such that the low-pressure gallery 12-1 is connected to the low-pressure oil line 16 through the oil groove 24. As a result, the oil control hole 25 is disconnected from the high-pressure gallery 12-2 as in the section X of FIG. 7, and the oil groove 24 is connected to the low-pressure gallery 12-1 as in the section Y of FIG. 4. Thus, the low-pressure oil in the low-pressure oil line 16 is supplied to the CDA latching pin 40-1 operated with high-pressure oil and the VVL latching pin 40-2 operated with low-pressure oil.

Accordingly, in the hydraulic control mode 1, when the actuator 50 is turned off, the oil groove 24 is connected to the low-pressure oil line 16, and the oil control hole 25 is disconnected from the high-pressure oil line 14. Thus, the VVL device 32 is operated by the VVL latching pin 40-2 with low-pressure oil supplied thereto, but the CDA device 31 is not operated due to the CDA latching pin 40-1 which is not operated by non-supply of high-pressure oil required for operation instead of low-pressure oil. Consequently, the VVL device 32 is in an ON state and the CDA device 32 is in an OFF state by low-pressure oil.

Referring to FIG. 8, in a hydraulic control mode 2, the controller 60 is configured to control actuator to be turned on. As such, the actuator 50 rotates the position of the rotation shaft valve 20 by an angle of 90° such that the high-pressure gallery 12-2 is connected to the high-pressure oil line 14 through the oil control hole 25. As a result, the oil control hole 25 is connected to the high-pressure gallery 12-2 as in the section X of FIG. 9, wherein the oil groove 24 is disconnected from the low-pressure gallery 12-1 as in the section Y of FIG. 9. Thus, the high-pressure oil in the high-pressure oil line 14 is supplied to the CDA latching pin 40-1 operated with high-pressure oil and the VVL latching pin 40-2 operated with low-pressure oil.

Accordingly, in the hydraulic control mode 2, when the actuator 50 is turned on, the oil groove 24 is disconnected from the low-pressure oil line 16, and the oil control hole 25 is connected to the high-pressure oil line 14. Thus, the CDA device 31 is operated by the CDA latching pin 40-1 with high-pressure oil supplied thereto, but the VVL device 32 is not operated due to the VVL latching pin 40-2 which is not operated by non-supply of low-pressure oil required for operation instead of high-pressure oil. Consequently, the CDA device 31 is in an ON state and the VVL device 31 is in an OFF state by high-pressure oil.

Meanwhile, FIGS. 10 to 15 are diagrams illustrating a four-cylinder engine system 100 that includes and utilizes the variable valve control system 1.

Figure 10:
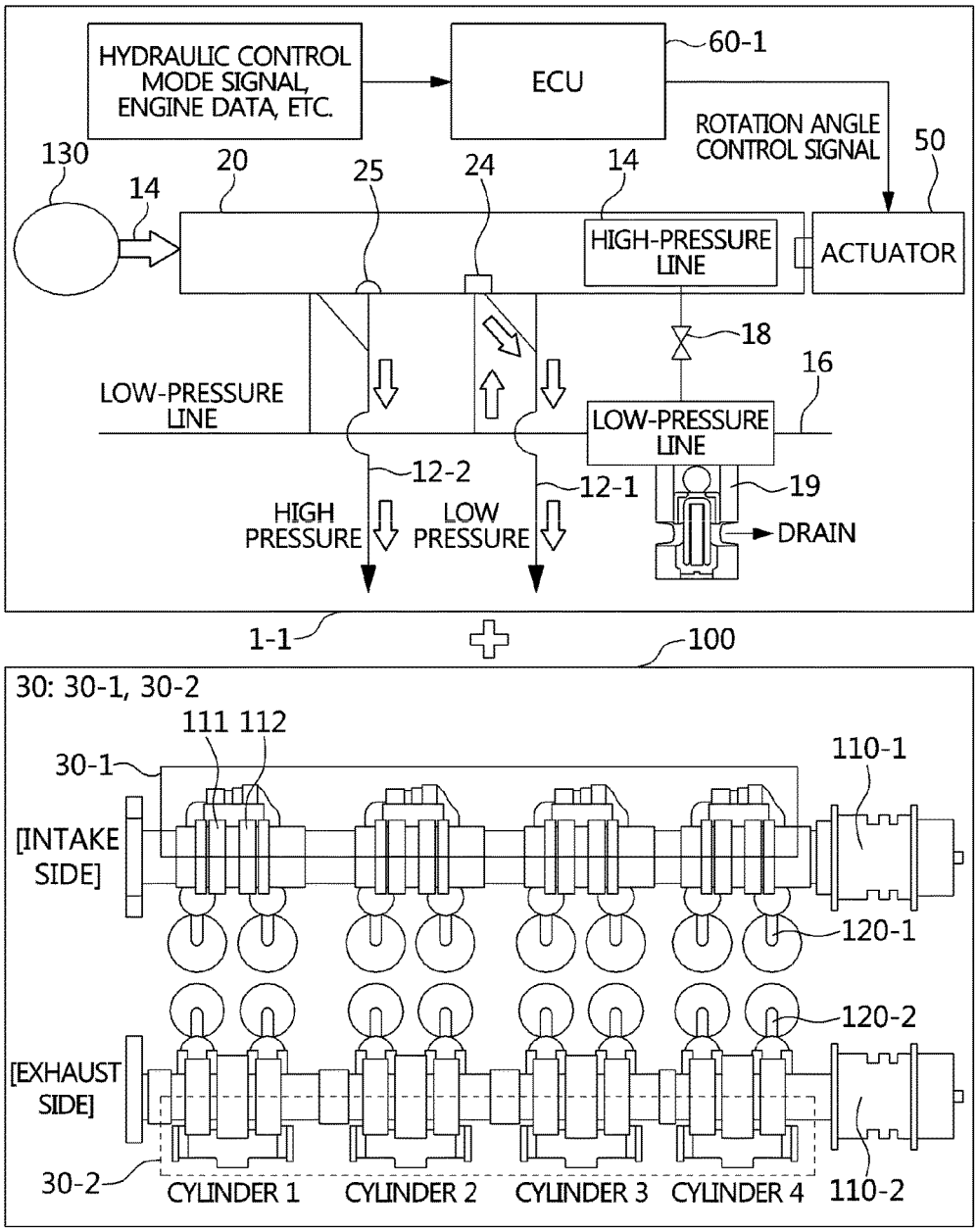
FIG. 10 is a diagram illustrating an engine system including a variable valve control system according to another exemplary embodiment of the present invention.

Referring to FIG. 10, the engine system 100 includes a CDA/VVL-type variable valve control system 1-1, an electronic control unit (ECU) 60-1, an engine 100-1, intake and exhaust camshafts 110-1 and 110-2, intake and exhaust valve sets 120-1 and 120-2, and an oil pump 130.

In detail, the CDA/VVL-type variable valve control system 1-1 includes an oil control circuit block 10, a rotation shaft valve 20, a variable valve mechanism 30, a latching pin 40, an actuator 50, and a controller 60, and is similar to the variable valve control system 1 described with reference to FIGS. 1 to 9. However, since the CDA/VVL-type variable valve control system 1-1 is applied to the four-cylinder engine 100-1, it differs from the variable valve control system 1 in that the CDA/VVL-type variable valve control system 1-1 includes a variable intake valve mechanism 30-1 and a variable exhaust valve mechanism 30-2, the oil control circuit block 10 is supplied with oil from the oil pump 130 driven by the engine 100-1, the variable valve mechanism 30 is configured to mix a three-stage CDA/VVL mechanism 30A, a two-stage CDA mechanism 30B, and a two-stage VVL mechanism 30C, and the controller 60 is changed to the ECU 60-1 controlling the engine 100-1. In the instant case, the ECU 60-1 is functionally similar to a typical engine ECU that controls a four-cylinder engine, and further includes an ON/OFF function of the actuator 50 and a PWM duty function in the CDA/VVL-type variable valve control system 1-1.

In detail, the engine 100-1 is a four-cylinder engine controlled by the ECU 60-1, and each cylinder is provided with the intake valve set 120-1 connected to the intake camshaft 110-1, the exhaust valve set 120-2 connected to the exhaust camshaft 110-2, the cylinder block of the engine 100-1, and the oil pump 130 for supplying oil to the variable intake valve mechanism 30-1 and the variable exhaust valve mechanism 30-2. Furthermore, each of the intake camshaft 110-1 and the exhaust camshaft 110-2 includes a normal cam 111 which is connected to a CDA device 31 to control intake and exhaust valve lift of each cylinder, and a VVL cam 112 which is connected to a VVL device 32 to control intake and exhaust valve lift of each cylinder. Therefore, the normal cam 11 and the VVL cam 112 are located at each cylinder to control an intake valve for each cylinder of the intake valve set 120-1 and an exhaust valve for each cylinder of the exhaust valve set 120-2.

Meanwhile, FIGS. 11 to 14 illustrate an example of real realization of the engine system 100 to which the CDA/VVL-type variable valve control system 1-1 is applied. Here, the term "Atkinson" means an Atkinson cycle, and the Atkinson cycle is a cycle in which an expansion stroke is maintained in a state that it is larger than an intake stroke and the cylinder pressure larger than the atmospheric pressure is changed into work in the initial stage of an exhaust stroke to obtain a further improvement in fuel efficiency. Furthermore, a Miller cycle is a cycle that improves the Atkinson cycle, and is used as the same meanings as the Atkinson cycle. These Atkinson cycle and Miller cycle are applied to a hybrid engine.

Figure 11:
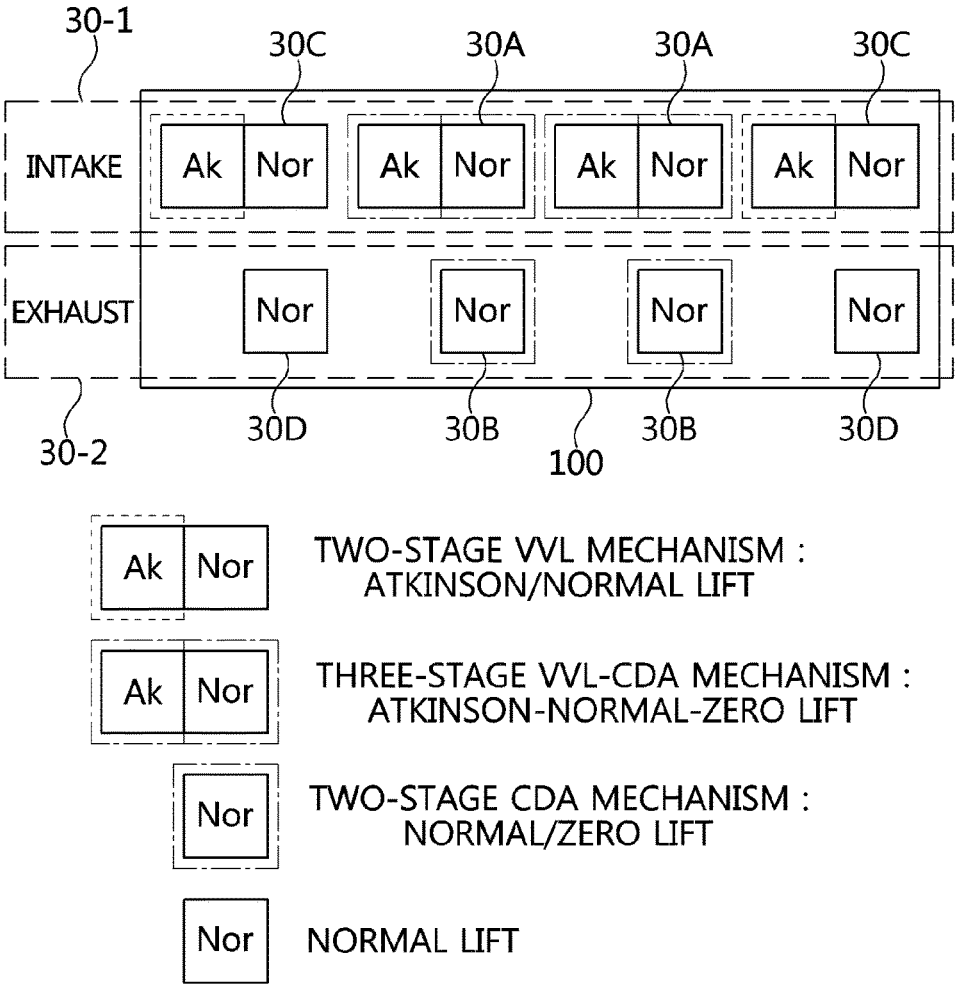
FIG. 11 is a view illustrating layout of two- and three-stage variable valve mechanisms for integrated control of CDA/VVL in the engine system according to the exemplary embodiment of the present invention.

Referring to the layout of the engine system 100 using the CDA/VVL-type variable valve control system 1-1 illustrated in FIG. 11, in the layout of the engine system, the four-cylinder engine 100-1 is divided into an intake side provided with the variable intake valve mechanism 30-1 and an exhaust side provided with the variable exhaust valve mechanism 30-2. The variable intake valve mechanism 30-1 includes a three-stage CDA/VVL mechanism 30A and a two-stage VVL mechanism 30C, and the variable exhaust valve mechanism 30-2 includes a two-stage CDA mechanism 30B and a single standard mechanism 30D.

Accordingly, in each of first and fourth cylinders of the engine 100-1, the two-stage VVL mechanism 30C is applied to the intake side to control intake valve lift in a variable two-stage manner (e.g. Atkinson (high) and normal), and the single standard mechanism 30D is applied to the exhaust side to control exhaust valve lift in a normal (standard) manner. On the other hand, in each of second and third cylinders of the engine 100-1, the three-stage CDA/VVL mechanism 30A is applied to the intake side to control intake valve lift in a variable three-stage manner (e.g. Atkinson (high), normal, and zero), and the two-stage CDA mechanism 30B is applied to the exhaust side to control exhaust valve lift in a variable two-stage manner (e.g. normal and zero).

Figure 12:
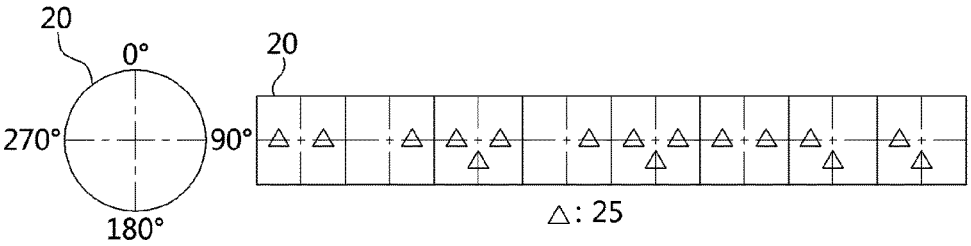
FIG. 12 is a view illustrating layout of a rotation shaft valve for integrated control of CDA/VVL according to the exemplary embodiment of the present invention.

Referring to the layout of the oil control hole of the rotation shaft valve 20 used in the CDA/VVL-type variable valve control system 1-1 illustrated in FIG. 12, high-pressure oil is supplied to the CDA latching pin 40-1 of the variable exhaust valve mechanism 30-2 and the CDA latching pin 40-1 and VVL latching pin 40-2 of the variable intake valve mechanism 30-1 through the oil control hole 25 to turn on the latching pins.

In detail, when the shaft body 21 of the rotation shaft valve 20 is divided into circular sections by angles of 0°, 90°, 180°, 270°, and 360°, the oil control hole 25 is circumferentially formed in the shaft body 21 according to each of first to fourth cylinders. For example, in the case where the variable valve mechanism is divided into the two-stage VVL mechanism 30C (#1) of the first cylinder, the three-stage CDA/VVL mechanism 30A (#2 and #3) and two-stage CDA mechanism 30B (#7) of the second cylinder, the three-stage CDA/VVL mechanism 30A (#4 and #5) and two-stage CDA mechanism 30B (#8) of the third cylinder, and the two-stage VVL mechanism 30C (#6) of the fourth cylinder, the oil control hole 25 is formed at each of 90 and 270 degree positions #1 for the VVL latching pin 40-2, a 90 degree position #2 for the VVL latching pin 40-2, 90, 180, and 270 degree or 180 and 270 degree positions #3 for the CDA latching pin 40-1, a 90 degree positions #4 for the VVL latching pin 40-2, 90, 180, and 270 degree or 180 and 270 degree positions #5 for the CDA latching pin 40-1, 90 and 270 degree positions #6 for the VVL latching pin 40-2, 180 and 270 degree positions #7 for the CDA latching pin 40-1, and 180 and 270 degree positions #8 for the CDA latching pin 40-1.

Figure 13:
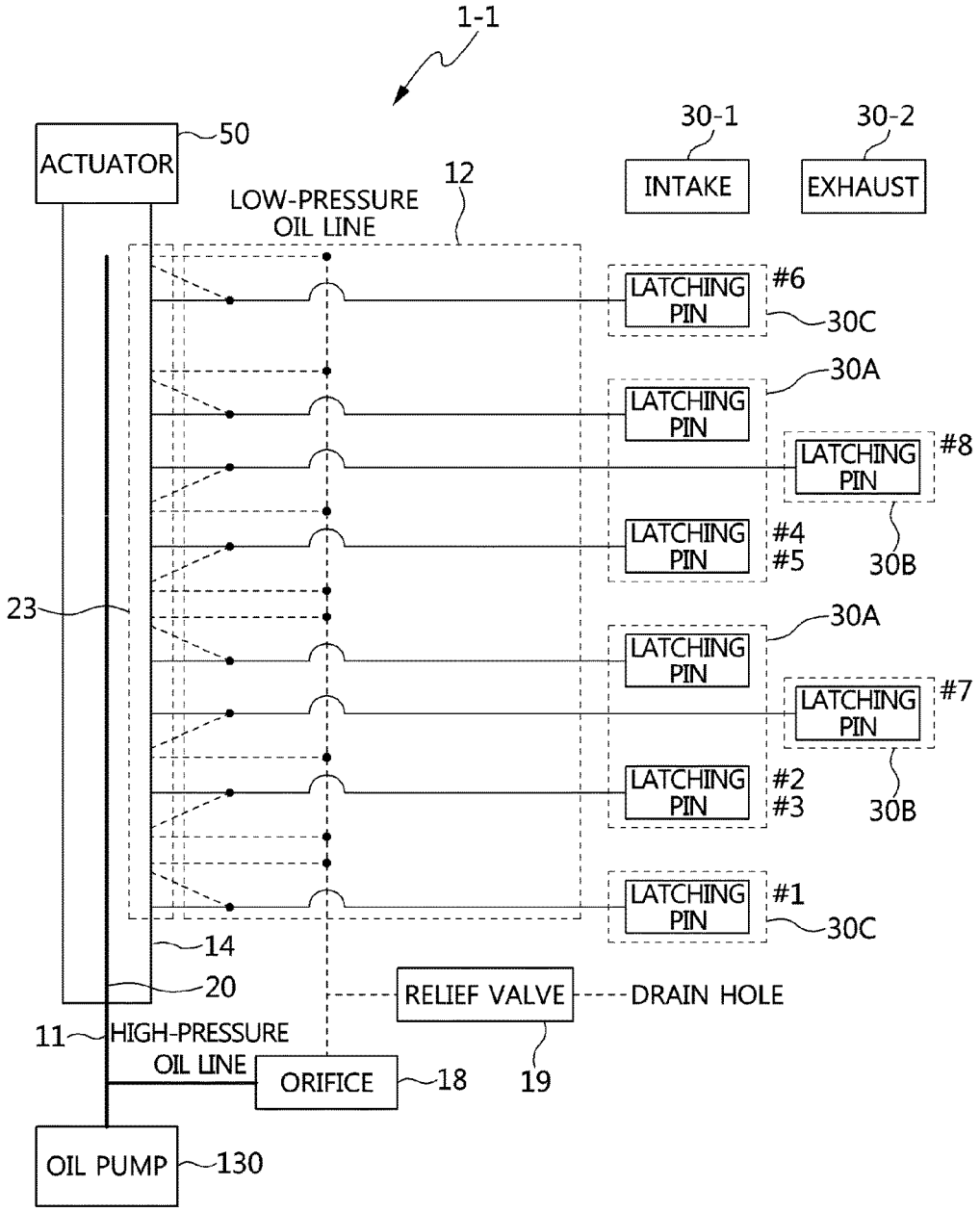
FIG. 13 is a view illustrating layout of an oil control circuit for low/high-pressure oil control of the rotation shaft valve according to the exemplary embodiment of the present invention.

Referring to the layout of the oil control circuit illustrated in FIG. 13, the main gallery 11 is connected such that the oil supplied from the oil pump 130 is supplied to the high-pressure oil line 14. When the high-pressure oil line 14 is connected to the low-pressure oil line 16 having the relief valve 19 through the orifice 18, high-pressure or low-pressure oil is selectively supplied to the control gallery 12 through the oil passage 23 according to the rotation angle of the rotation shaft valve 20, and the high-pressure or low-pressure oil is selectively supplied to the CDA latching pin 40-1 and the VVL latching pin 40-2 through the control gallery 12.

Thus, the engine system 100 may be controlled in the following engine control mode by the CDA/VVL-type variable valve control system 1-1.

For example, when the rotation shaft valve 20 is positioned at 0 degree (initial setting position), high-pressure oil is not supplied to #1/#6 VVL latching pins 40-2, #2/#3/#4/#5 CDA latching pins 40-1 and VVL latching pins 40-2, and #7/#8 CDA latching pins 40-1 through the oil control hole 25 so that the latching pins are maintained in an OFF state. Therefore, low-pressure oil is supplied to the CDA latching pin 40-1 and the VVL latching pin 40-2 through the oil groove 24.

For example, when the actuator 50 is operated by the control of the ECU 60-1 so that the rotation shaft valve 20 is rotated by angles of 90°, 180°, and 270°, the CDA latching pin 40-1 and the VVL latching pin 40-2 are selectively changed from OFF to ON at each angle. For example, at 90 degrees, high-pressure oil is supplied to #1/#2/#4/#6 VVL latching pins 40-2 and #3/#5 CDA latching pins 40-1 or #1/#2/#4/#6 VVL latching pins 40-2 through the oil control hole 25 so that the latching pins are changed to an ON state, and the supply of low-pressure oil to #3/#5/#7/#8 CDA latching pins 40-1 or #7/#8 CDA latching pins 40-1 through the oil groove 24 is maintained so that the latching pins are maintained in an OFF state. At 180 degrees, high-pressure oil is supplied to #3/#5/#7/#8 CDA latching pins 40-1 through the oil control hole 25 so that the latching pins are changed to an ON state, and the supply of low-pressure oil to #1/#2/#4/#6 VVL latching pins 40-2 through the oil groove 24 is maintained so that the latching pins are maintained in an OFF state. At 270 degrees, high-pressure oil is supplied to #3/#5/#7/#8 CDA latching pins 40-1 and #1/#6 VVL latching pins 40-2 through the oil control hole 25 so that the latching pins are changed to an ON state, and the supply of low-pressure oil to /#2/#4 VVL latching pins 40-2 through the oil groove 24 is maintained so that the latching pins are maintained in an OFF state.

As a result, the engine 100-1 may be operated in various engine control modes by controlling lift of the intake valve set 120-1 by the three-stage CDA/VVL mechanism 30A and the two-stage VVL mechanism 30C in a variable two and three-stage manner at the intake side thereof, and by controlling lift of the two-stage CDA mechanism 30B in a variable two-stage manner at the exhaust side thereof. For example, it is possible to further improve fuel efficiency since the engine 100-1 is controlled in the middle and high load driving region and by CDA/VVL and in the low load driving region by CDA in the Atkinson cycle (or Miller cycle). Furthermore, it is possible to further improve fuel efficiency by CDA of each cylinder during coasting.

FIG. 14 illustrates an example of an engine control mode for each cylinder realized in the engine system 100 having the CDA/VVL-type variable valve control system 1-1/

Figure 15:
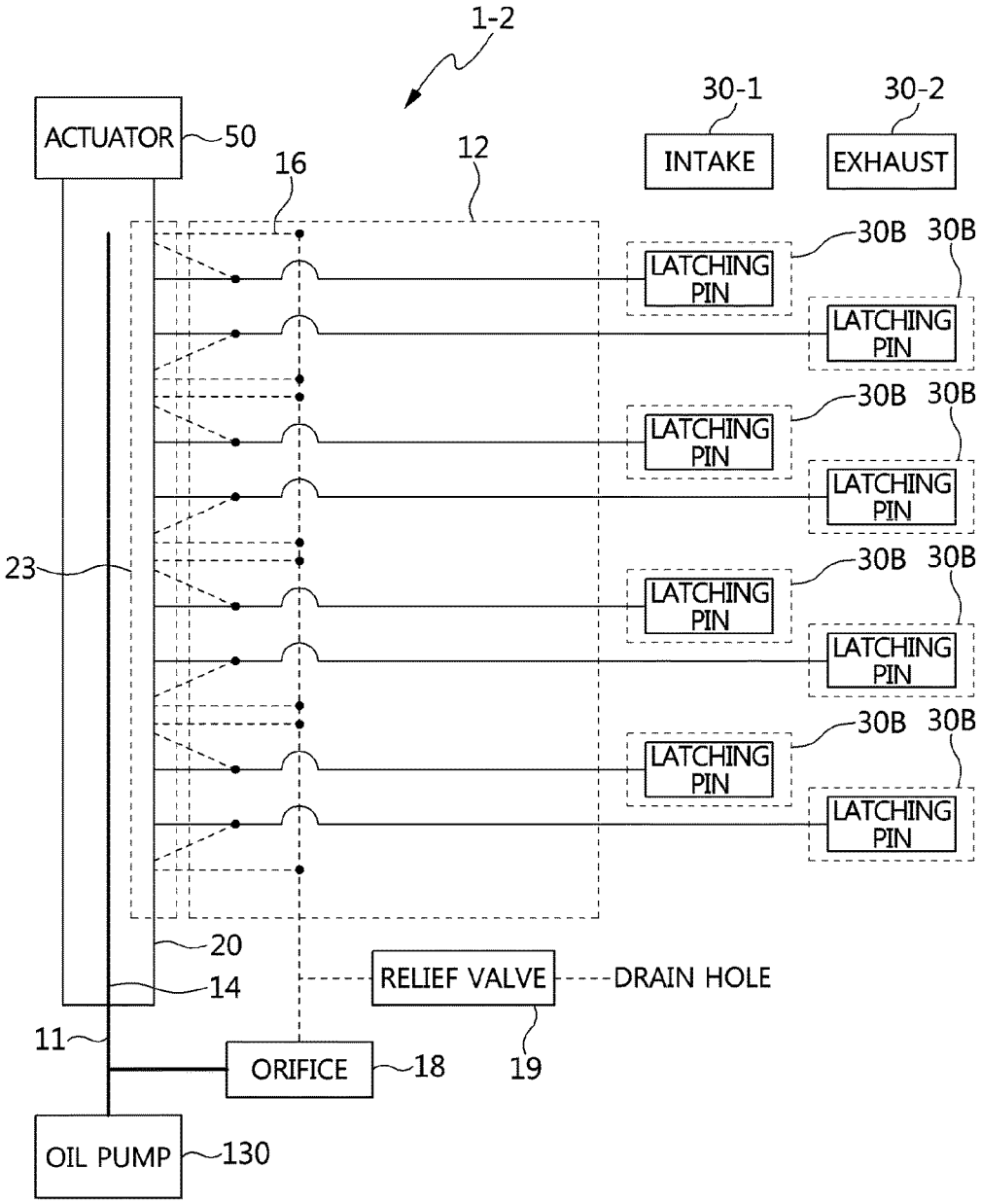
FIG. 15 is an example of layout of the oil control circuit for controlling the engine system to be overall cylinder deactivation according to the exemplary embodiment of the present invention.

Meanwhile, FIG. 15 illustrates an example of an oil control circuit of a CDA-type variable valve control system 1-2. As illustrated in the drawing, the CDA-type variable valve control system 1-2 is similar to the CDA/VVL-type variable valve control system 1-1. However, the CDA-type variable valve control system 1-2 differs from the CDA/VVL-type variable valve control system 1-1 in that the three-stage CDA/VVL mechanism 30A, the two-stage CDA mechanism 30B, and the two-stage VVL mechanism 30C are properly combined and applied to the first to fourth cylinders of the engine 100-1 in the CDA/VVL-type variable valve control system 1-1 and only the two-stage CDA mechanism 30B is integrally applied to the first to fourth cylinders of the engine 100-1 in the CDA-type variable valve control system 1-2.

Accordingly, the engine system 100 having the CDA-type variable valve control system 1-2 can further improve fuel efficiency compared to the engine system 100 having the CDA/VVL-type variable valve control system 1-1 during the same coasting condition, since all first to fourth cylinders are changed to be CDA during coasting by integral control of the two-stage CDA mechanism 30B in the CDA-type variable valve control system 1-2.

As described above, the engine system 100 according the present embodiment includes the variable valve control system 1 including the variable valve mechanism 30 that is configured to perform valve lift in a variable multistage manner by changing the latching pin 40 to be turned on/off by a pressure difference of low/high-pressure oil, the oil control circuit block 10 having the high-pressure oil line 14 filled with high-pressure oil, the low-pressure oil line 16 filled with low-pressure oil, and the control gallery 12 connected to the latching pin 40 for supply of low/high-pressure oil, the rotation shaft valve 20 having the oil passage 23 for switching low-pressure oil and high-pressure oil supplied to the control gallery 12, and the actuator 50 that generates rotary power for switching of the rotation shaft valve 20. Consequently, it is possible to replace a plurality of OCVs with the single rotation shaft valve 20 without a difficulty of system packing and an increase in cost, and to increase marketability through an improvement in fuel efficiency and a torque by various engine control modes in the middle and high load/low load regions of the engine and during coasting.

The variable valve control system and the engine system according to an exemplary embodiment of the present invention have the following operations and effects by application of the single rotation shaft valve as a common valve for an OCV function.

In terms of the variable valve control system, firstly, a new system can be realized by application of the rotation shaft valve for hydraulic control. Secondly, since the OCV is replaced with the oil passage of the rotation shaft valve, the oil control circuit can be configured without limitation due to the OCV. Thirdly, since the oil control circuit is formed as the single rotation shaft valve for various engine control modes, the system can be packaged under the same function. Fourthly, it is possible to form a complicated oil control circuit only by adding the oil passage of the rotation shaft valve. Fifthly, since the number of rotation shaft valves is not increased even though the engine operation mode is extended due to the complicated oil control circuit, it is possible to resolve an increase in cost compared to the OCV. Sixthly, since the rotation shaft valve connects the low-pressure oil line to the high-pressure oil line, it is possible simplify the complicated oil control circuit for various engine control modes.

In terms of the engine system, firstly, it is possible to improve fuel efficiency with a minimum increase in cost in engine control modes using CDA and VVL of the variable valve control system, and thus to increase cost effectiveness of the system. Secondly, it is possible to improve fuel efficiency in the overall driving region of the engine by divisionally applying the VVL Atkinson cycle to the middle and high load region of the engine, applying CDA to the low load region of the engine, and applying overall cylinder deactivation during coasting. Thirdly, it is possible to increase marketability through an improvement in fuel efficiency and a torque by realization of optimal intake and exhaust valve modes according to the driving region of the engine. Fourthly, it is possible to selectively or simultaneously control CDA and VVL for realization of various engine control modes only by division of low/high-pressure oil lines connected to the oil pump. Fifthly, it is possible to further improve fuel efficiency of a conventional system with more ease almost without changing the oil circuit.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with respect to the positions of such features as displayed in the figures.

The foregoing descriptions of predetermined exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain principles of the invention and their practical application, to be configured for others skilled in the art to make and utilize exemplary embodiments of the present invention, as well as alternatives and modifications thereof. It is intended that the scope of the invention be defined by the Claims appended hereto and their equivalents.

What is claimed is:

1. A variable valve control system comprising:

a variable valve mechanism having latching pins for performing variable valve lift by a pressure difference of oil;

an oil control circuit block having a low-pressure oil line and a high-pressure oil line to control ON/OFF of the latching pins; and a rotation shaft valve having oil passages for switching the love-pressure oil line and the high-pressure oil line, wherein the high-pressure oil line is formed inside the rotation shaft valve using a shaft hole of the rotation shaft valve, and wherein the low-pressure oil line is formed outside the rotation shaft valve.

2. The variable valve control system of claim 1, wherein the oil passages are matched with the latching pins one to one, and are disposed in a longitudinal direction of the rotation shaft valve to correspond to a number of latching pins.

3. The variable valve control system of claim I, wherein the rotation shaft valve is built in the oil control circuit block, and the oil control circuit block is connected to the variable valve mechanism.

4. The variable valve control system of claim 1, wherein the oil control circuit block is further provided with a main gallery and a control gallery, the oil is supplied to the high-pressure oil line and the low-pressure oil line through the main gallery so that the high-pressure oil line and the low-pressure oil line are filled with the oil, and the control gallery fluidically-communicates with the oil passages so that a low-pressure oil of the low-pressure oil line and a high-pressure oil of the high-pressure oil line switched by the rotation shaft valve are supplied to the latching pins.

5. The variable valve control system of claim 4, wherein each of the oil passages includes an oil groove recessed on a circumferential surface of the rotation shaft valve, and an oil control hole circumferentially formed to fluidically-communicate with the shaft hole, and the low-pressure oil is supplied to the control gallery through the oil groove and wherein the high-pressure oil is supplied to the control gallery through the oil control hole.

6. The variable valve control system of claim 5, wherein the oil groove and the oil control hole form a predetermined phase angle difference.

7. The variable valve control system of claim 5, wherein the control gallery is divided into a low-pressure gallery fluidically-communicating with the oil groove, and a high-pressure gallery fluidically-communicating with the oil control hole.

8. The variable valve control system of claim 1, wherein the high-pressure oil line and the low-pressure oil line are connected to an orifice, and the orifice acts such that the low-pressure oil line is continuously filled with the oil.

9. The variable valve control system of claim 8, wherein the low-pressure oil line is provided with a relief valve, and the relief valve is configured to lower an increase of pressure in the low-pressure oil line using a drain hole.

10. The variable valve control system of claim 1, wherein the rotation shaft valve is connected to an actuator, the actuator adjusts a rotation angle of the rotation shall valve, such that an adjustment of the rotation angle allows the low-pressure oil and the high-pressure oil to be switched in the oil passages.

11. An engine system comprising:

a variable valve control system including a variable valve mechanism having latching pins for performing variable valve lift such that the latching pins are changed from OFF to ON by a pressure difference of oil, an oil control circuit block having a high-pressure oil line filled with high-pressure oil for turning on the latching pins, a low-pressure oil line filled with low-pressure oil for turning off the latching pins, and a control gallery through which the high-pressure oil line and the low-pressure oil line are connected to the latching pins, a rotation shaft valve having oil passages for switching the low-pressure oil line and the high-pressure oil line connected to the control gallery, and an actuator configured to adjust an rotation angle of the rotation shaft valve, allowing the low- pressure oil line and the high-pressure oil line to be switched in the oil passages; and a controller configured to control the actuator.

12. The engine system of claim 11, wherein the variable valve control system includes a variable intake valve mechanism provided at an intake side of an engine and a variable exhaust valve mechanism provided at an exhaust side thereof.

13. The engine system of claim 12, wherein the variable intake valve mechanism includes a three-stage cylinder deactivation (CDA)/variable valve lift (VVL) mechanism and a two-stage VVL mechanism as the variable valve mechanism, and the variable exhaust valve mechanism includes a two-stage CDA mechanism and a single standard mechanism as the variable valve mechanism.

14. The engine system of claim 13, wherein the three-stage CDA/VVL mechanism utilizes CDA latching pins and VVL latching pins as the latching pins, the two-stage CDA mechanism utilizes the CDA latching pins as the latching pins, and the two-stage VVL mechanism utilizes the VVL latching pins as the latching pins.

15. The engine system of claim 11, wherein the oil is an engine oil supplied from an oil pump to an engine.

16. The engine system of claim 11, wherein the controller is an electronic control unit (ECU) to control an engine.

* * * * *